US008528338B2

(12) United States Patent
Desai et al.

(10) Patent No.: US 8,528,338 B2
(45) Date of Patent: Sep. 10, 2013

(54) METHOD FOR OPERATING AN AIR-STAGED DIFFUSION NOZZLE

(75) Inventors: Anand Prafulchandra Desai, Karnataka (IN); Karthick Kaleeswaran, Karnataka (IN); Venugopal Polisetty, Andhra Pradesh (IN)

(73) Assignee: General Electric Company, St. Paul, MN (US)

( * ) Notice: Subject to any disclaimer, the term of this patent is extended or adjusted under 35 U.S.C. 154(b) by 442 days.

(21) Appl. No.: 12/960,782

(22) Filed: Dec. 6, 2010

(65) Prior Publication Data

US 2012/0137703 A1 Jun. 7, 2012

(51) Int. Cl.
*F02C 1/00* (2006.01)
*F02G 3/00* (2006.01)

(52) U.S. Cl.
USPC ..... 60/748; 60/742; 60/39.465; 60/740; 60/737; 239/399

(58) Field of Classification Search
USPC ..... 60/748, 737, 746, 747, 804, 740, 60/742, 39.465; 239/399, 403, 404
See application file for complete search history.

(56) References Cited

U.S. PATENT DOCUMENTS

| | | | | |
|---|---|---|---|---|
| 4,798,330 | A | 1/1989 | Mancini et al. | |
| 5,450,725 | A | 9/1995 | Takahara et al. | |
| 5,647,538 | A | 7/1997 | Richardson | |
| 5,778,676 | A * | 7/1998 | Joshi et al. | 60/746 |
| 5,833,141 | A | 11/1998 | Bechtel, II et al. | |
| 6,363,724 | B1 | 4/2002 | Bechtel et al. | |
| 6,453,673 | B1 | 9/2002 | Bechtel et al. | |
| 8,141,363 | B2 * | 3/2012 | Khan et al. | 60/740 |
| 8,312,722 | B2 * | 11/2012 | York et al. | 60/737 |
| 2010/0031661 | A1 | 2/2010 | Varatharajan et al. | |

* cited by examiner

*Primary Examiner* — William H Rodriguez
(74) *Attorney, Agent, or Firm* — Ernest G. Cusick; Frank A. Landgraff

(57) ABSTRACT

A method is provided for operating an air-staged diffusion nozzle for a gas turbine combustor to cool the nozzle tip and improve mixing of gas fuel and air within a downstream burner space. Air is mixed with the gas-fuel in an outer swirler and expanded in a downstream burner tube space. Compressed air from a cooling air cavity in the nozzle flows through an inner swirler, passing downstream from the tip of the nozzle to the burner tube space, cooling the nozzle tip and improving the mixing of the gas-fuel with air, thereby reducing emissions from the gas turbine and reducing soot formation in startup. Direction and rotation of the discharged air from the nozzle tip into the burner space may be arranged to promote nozzle tip cooling and gas-fuel mixing with air.

17 Claims, 9 Drawing Sheets

METHOD FOR OPERATING AN AIR-STAGED DIFFUSION NOZZLE

BACKGROUND OF THE INVENTION

The invention relates generally to gas turbines and more specifically to air-staged diffusion nozzles for gas turbine combustors.

In a diffusion nozzle for a gas turbine combustor, the fuel begins mixing with air in swirl vanes and then flows and expands in a swirling motion within the burner tube space of the combustor for mixing. In the current diffusion nozzles, a low velocity region was observed in the burner tube at the center of diffusion nozzle. High carbon formation on the diffusion nozzle tip has been identified during the start up as well as part load operation. For a highly reactive fuel, higher temperature is observed on the nozzle tip due to proximity of the flame. Further, enhanced mixing of the gas-fuel and air in the burner tube can result in reduced emissions from the gas turbine.

Accordingly, there is a need for a diffusion nozzle with a gas-fuel that provides for cooling of the nozzle tip while at the same time improving mixing of the fuel and air.

BRIEF DESCRIPTION OF THE INVENTION

The present invention relates to an air-staged nozzle. Briefly in accordance with one aspect of the present invention an embodiment is provided for an air-staged diffusion nozzle disposed in a combustor of a gas turbine, including a gas-fuel source and a compressed air source where the gas-fuel nozzle discharges to a burner tube space of the combustor. The air-staged diffusion nozzle includes a nozzle body disposed along a longitudinal axis including a gas-fuel cavity, bounded downstream by an end closure wall, bounded upstream by a connection to a gas-fuel source, and bounded peripherally by an annular wall. An outer swirler with swirl vanes extends from a tip end of the annular wall forming a swirled axial passage to a downstream burner tube space. A space external to the annular wall of the gas-fuel cavity includes a compressed air source in fluid communication with the swirled axial passage of the outer swirler. Passages are provided for gas-fuel through the first annular wall from the gas-fuel cavity into the swirled axial annular passage of the outer swirler. The outer swirler delivers a swirling mixture of a gas-fuel and the compressed air to the downstream burner tube space of the combustor. A cooling air chamber is enclosed within the gas-fuel cavity and is surrounded with an outer peripheral wall. A portion of the outer peripheral wall, disposed in proximity to the downstream end of the gas-fuel cavity, extends axially through the end closure wall to the burner tube space of the combustor. Passages through the annular wall of the gas-fuel cavity from the external compressed air space are coupled in fluid communication with the cooling air chamber. Passages fluidly communicate compressed air through the downstream end of the peripheral wall of the cooling air chamber to the burner tube space of the combustor, providing cooling air for the tip and enhancing mixing of the gas-fuel and air in the burner tube space.

According to another aspect of the present invention, a gas turbine combustor is provided including a compressor, a turbine, combustors, and air-staged diffusion nozzles with a gas-fuel source and a compressed air source wherein the air-staged diffusion nozzle discharges to a burner tube space of the combustor. The air-staged diffusion nozzle includes a nozzle body disposed along a longitudinal axis including a gas-fuel cavity, bounded downstream by an end closure wall, bounded upstream by a connection to a gas-fuel source, and bounded peripherally by an annular wall. An outer swirler with swirl vanes extends from a tip end of the annular wall, forming a swirled axial passage to a downstream burner tube space.

A space external to the annular wall of the gas-fuel cavity includes a compressed air source in fluid communication with the swirled axial passage of the outer swirler and a plurality of passages through the first annular wall from the gas-fuel cavity into the swirled axial annular passage of the outer swirler. The outer swirler delivers a swirling mixture of a gas-fuel and the compressed air to the downstream burner tube space of the combustor. A cooling air chamber enclosed within the gas-fuel cavity includes an outer peripheral wall. The outer peripheral wall is disposed in proximity to the downstream end of the gas-fuel cavity extending axially through the end closure wall to the burner tube space of the combustor. Multiple passages through the annular wall from the external compressed air space are coupled fluidly with the cooling air chamber. Multiple passages fluidly couple compressed air through the downstream end of the peripheral wall of the cooling air chamber to the burner tube space of the combustor.

A further aspect of the present invention provides a method for cooling a tip end of gas-fuel air-staged diffusion nozzle disposed in a combustor of a gas turbine with a compressor and a turbine, where the nozzle is upstream from a burner tube of the combustor. The method includes providing a gas-fuel air-staged diffusion nozzle including a nozzle body with a gas-fuel cavity bounded by an outer peripheral wall disposed along a longitudinal axis of the nozzle; an end closure wall; a cooling air chamber disposed within the gas-fuel cavity; an outer swirler supplied by gas-fuel from the gas-fuel cavity and compressed air from an external space surrounding the nozzle body; and a forward projection of the cooling air chamber, extending through the peripheral wall within and projecting through an end closure wall of the nozzle body. The method further includes supplying gas-fuel to the gas-fuel cavity from an upstream gas-fuel source. Gas-fuel is diverted to flow through gas-fuel injection holes defined about a periphery of the end closure wall into swirl passages of the outer swirler. The gas-fuel is mixed with compressed air from the external space within the outer swirler and discharged with a rotational direction into a burner tube space downstream from the end closure wall of the nozzle body. The method further includes diverting compressed air from the external space surrounding the nozzle body through the cooling air chamber to the burner tube space downstream from the end closure wall of the nozzle body, promoting cooling of the nozzle tip and mixing of the gas-fuel and air in the burner tube space.

Yet another aspect of the present invention provides a method of operating a gas-fuel air-staged diffusion nozzle disposed in a combustor of a gas turbine with a compressor and a turbine, where the nozzle is upstream from a burner tube of the combustor. The method includes providing a gas-fuel air-staged diffusion nozzle comprising a nozzle body including a gas-fuel cavity bounded by an outer peripheral wall disposed along a longitudinal axis of the nozzle; an end closure wall; a cooling air chamber disposed within the gas-fuel cavity; an outer swirler supplied by gas-fuel from the gas-fuel cavity and compressed air from an external space surrounding the nozzle body; and an inner swirler at a downstream end of the nozzle. The method includes supplying a gas-fuel to the gas-fuel cavity from an upstream gas-fuel source. The gas-fuel is diverted to flow through gas injection holes defined about a periphery of the end closure wall into swirl passages of the outer swirler. The gas-fuel is mixed with compressed air from the external space entering within the outer swirler and discharged from the outer swirler with a rotational direction into a burner tube space downstream from the nozzle body. The method also includes diverting compressed air from the external space surrounding the nozzle body into the cooling air chamber. The method further includes swirling the compressed air in the cooling air chamber through an inner swirler at a center of the tip end of the nozzle into the burner tube space downstream from nozzle, thereby cooling the tip of the nozzle and enhancing mixing of the gas-fuel and air mixture in the burner tube space.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention of an air-staged gas diffusion nozzle for a gas turbine combustor have many advantages, including enhancing the mixing of gas-fuel and air, thereby reducing gas turbine emissions and also reducing soot formation during startup. The air-staged diffusion nozzle will also extract air from the main air flow path and introduce an air flow at the center of the nozzle tip with a swirl. For highly reactive fuels in particular, elevated temperature is observed on the nozzle tip due to proximity of the flame. The introduction of this bypassed air will cool the nozzle tip, forming a film of cold air between the surface of the nozzle tip and the hot gases in the downstream burner tube. The air flow leaving the nozzle tip and the swirl motion imparted to the air flow acts to enhance the mixing of the gas-fuel with air. The inventive arrangement is desirable for Dry Low NOx (DLN) combustors with multiple diffusion nozzles and may also be used advantageously on single nozzle combustors.

Figure 1:
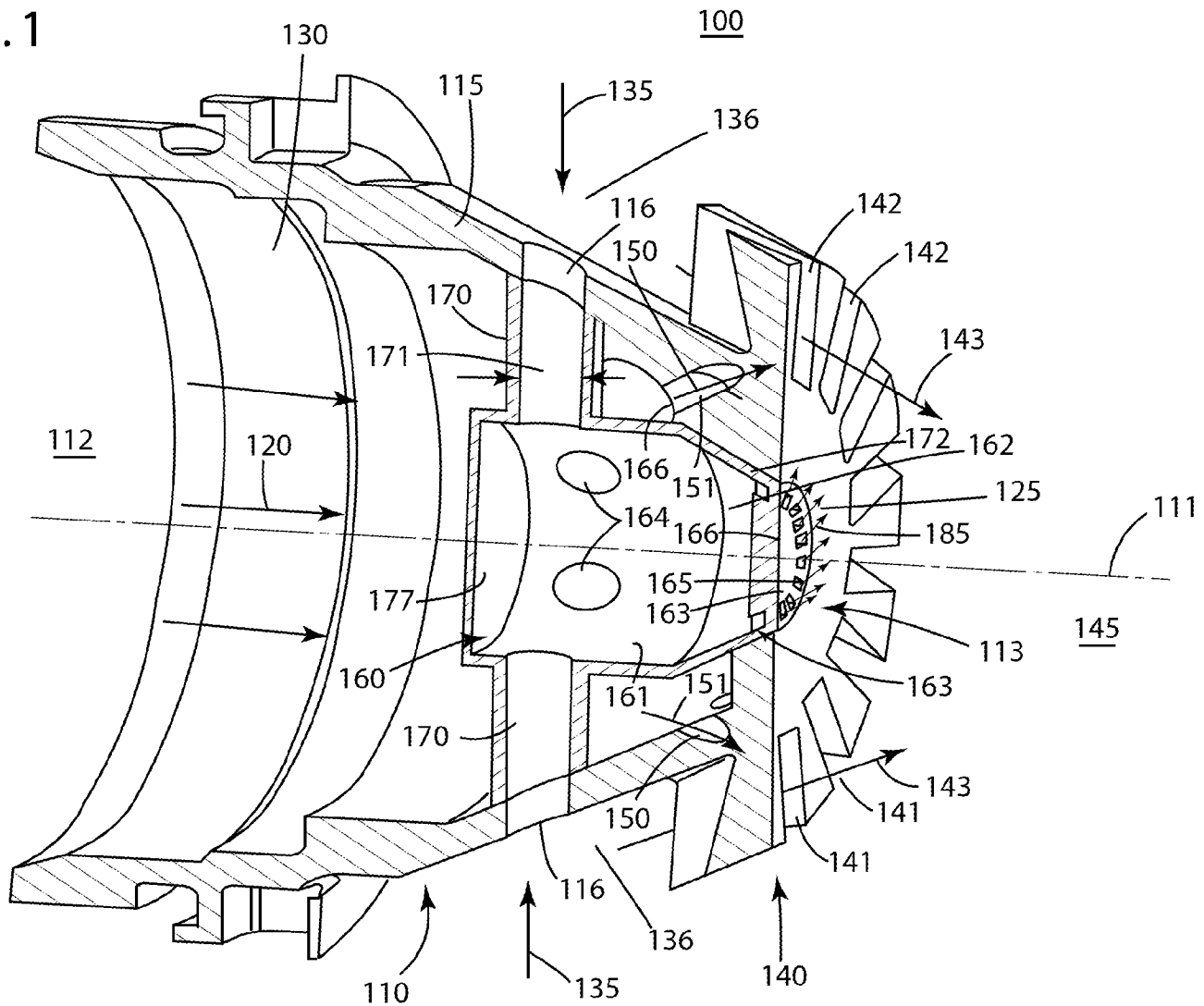
FIG. 1 illustrates an isometric cutaway view of an embodiment of an inventive air-staged diffusion gas nozzle.
Figure 8:
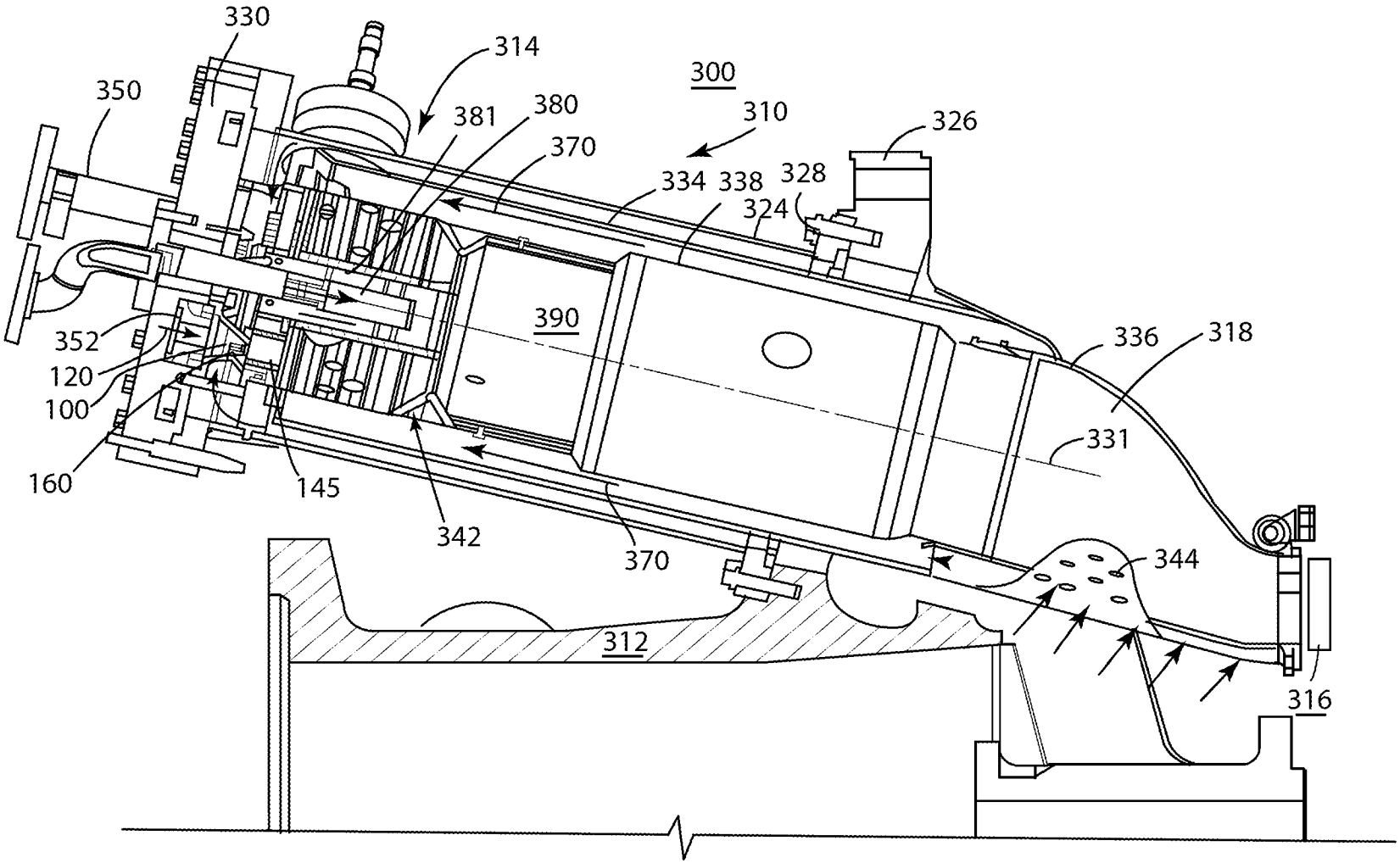
FIG. 8 illustrates a combustor for a gas turbine including embodiments of the inventive air-staged diffusion fuel nozzles organized around a center secondary fuel nozzle.

FIG. 1 illustrates a cutaway isometric view of an embodiment for an inventive air-staged diffusion nozzle for a combustor of a gas turbine. The air-staged diffusion nozzle 100 may include a frusto-conical nozzle body 110 on a longitudinal axis 111, bounded with a peripheral wall 115 and a downstream end closure wall 125 defining a gas-fuel cavity 130 within the nozzle body. The peripheral wall 115 may taper down in diameter from an upstream end 112 to a downstream tip end 113. A gas-fuel source 120 is provided from the upstream end 112 supplying the gas-fuel cavity 130. Compressed air 135 may be externally supplied from an external space 136 radially outward from the peripheral wall 115 and enclosed within the combustor (FIG. 8). The compressed air 135 may be supplied by discharge air from the gas turbine air compressor (FIG. 8). Swirl vanes 141 of outer swirler 140 may extend radially outward and downstream from the end closure wall 125 of the nozzle body 110 defining flow passages 142 to a downstream burner tube space 145. A plurality of gas-fuel passages 150 may penetrate through the peripheral wall 115 to supply gas-fuel 151 from the gas-fuel cavity 130 into each of the passages 142 between the swirl vanes 141. Gas-fuel flow and compressed air flow through each of the swirl vanes 141 initiate a swirling mix 143 of the gas-fuel and the compressed air that continues with the gas-fuel-compressed air mixture swirling in the burner tube 145 downstream from the nozzle 100.

A cooling air chamber 160 may be provided within the downstream end of the gas-fuel cavity 130 in proximity to end closure wall 125. The cooling air chamber 160 may include a peripheral wall 161 including a projecting portion 162 extending downstream through a center portion of the end closure wall 125 around the longitudinal axis 111. The peripheral wall 161 may be generally cylindrical along the longitudinal axis and closed on the upstream end. The projecting portion 162 may be frusto-conical, with sidewalls 172 tapering at the downstream end. The projecting portion 162 may be formed integral to the end closure wall 125.

The cooling air chamber 160 may be in flow communication with the external space 136 of compressed air 135. The flow communication path 165 may include corresponding penetrations 116 of the peripheral wall 115 and penetrations 164 of the cooling air chamber 160 interconnected with hollow tubing members 170. The number and size of penetrations 116, 164 and the number and diameter 171 of corresponding hollow tubing members 170 may be arranged to provide a sufficient volume of compressed air to the cooling air chamber 160 to supply needs for cooling the tip of the nozzle, limiting impingement of hot gases from the downstream burner tube space 145 onto the downstream surface of nozzle tip end 113, and promoting mixing within the downstream burner tube space 145. The hollow tubing 170 may be arranged radially between the peripheral wall 115 of the nozzle body 110 and the peripheral wall 161 of the cooling air chamber 160. The hollow tubing 170 may also be arranged in circumferential symmetry around cooling air chamber 160.

The downstream face 163 of the projecting portion 162 of cooling air cavity 160 may form a continuous flush surface with a downstream face 126 of the end closure wall 125. The projecting portion 162 may include a plurality of cooling flow passages 165 between the inner face 166 and downstream face 163. The cooling passages 165 may be arranged as an inner swirler 180 to provide discharges 195 forming rotational swirl of compressed air from the downstream face 163 into the burner tube 145, as will be described in greater detail.

Figure 2:
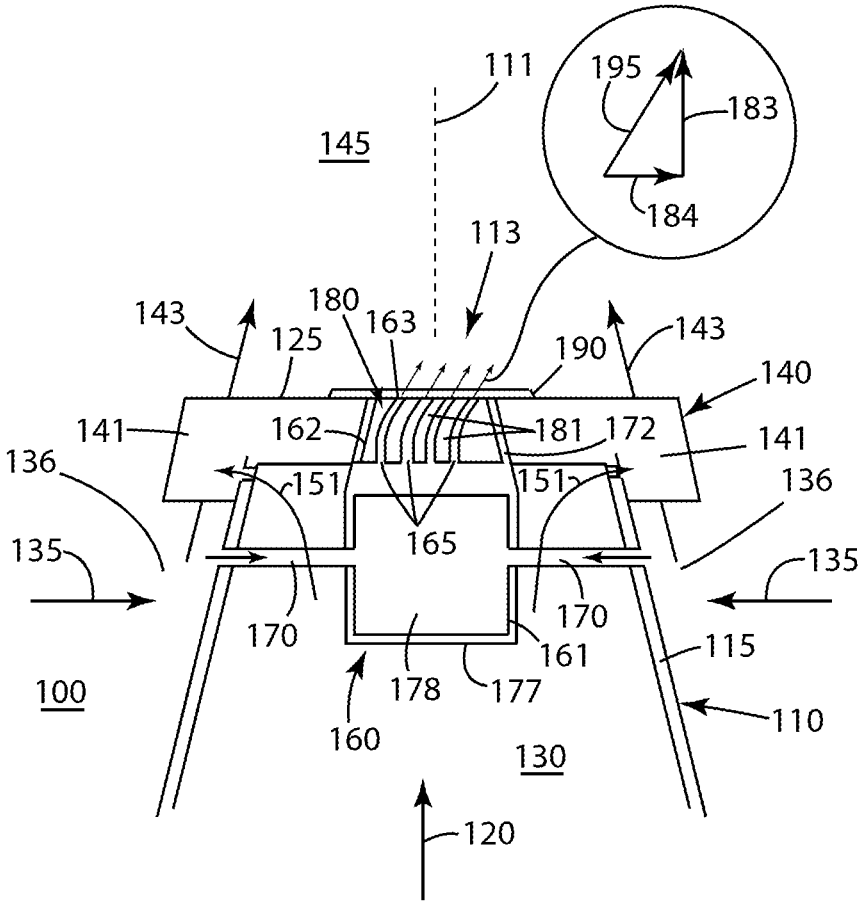
FIG. 2 illustrates an expanded cutaway side view illustrating cooling air flow through a swirler at the tip of an embodiment of an inventive air-staged diffusion gas nozzle.
Figure 3:
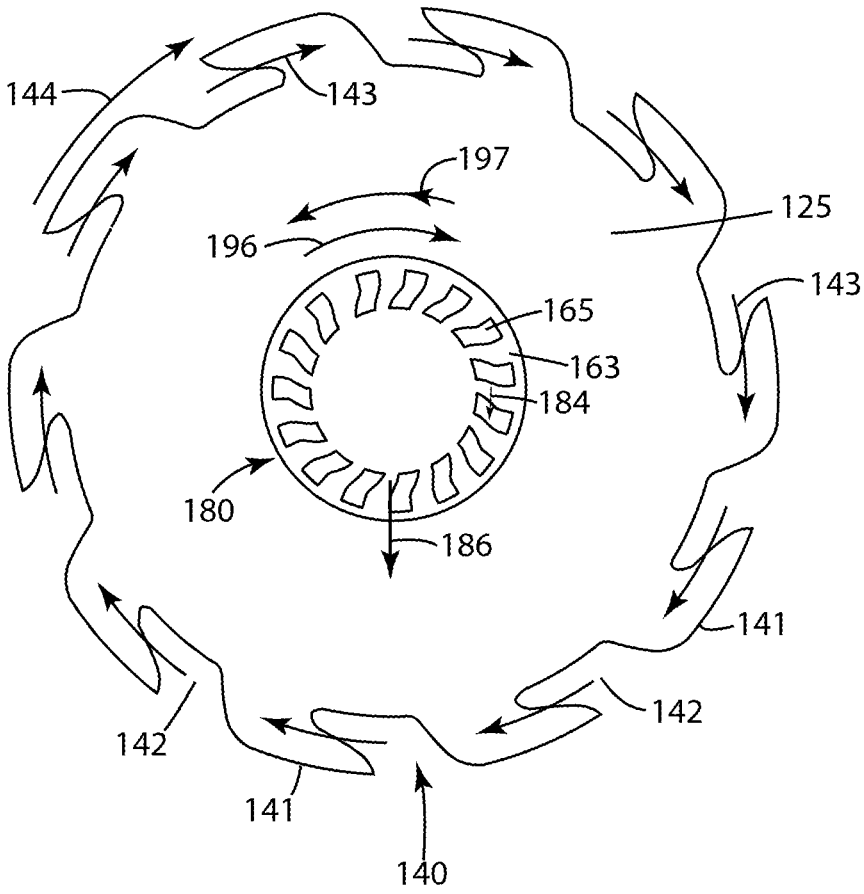
FIG. 3 illustrates an external view of the tip of end of an embodiment of the air-staged diffusion nozzle.

FIG. 2 illustrates a cross-sectional cutaway view of the air-staged diffusion nozzle. FIG. 3 illustrates an external view of the tip of end of the air-staged diffusion nozzle. More specifically, the passages 165 may be arranged within an inner swirler 180 between swirl vanes 181 that impart a discharge velocity 195 to the compressed air discharging into the burner tube 145. The discharge velocity 195 may include an axial velocity 183 and a circumferential velocity 184. The swirl vanes 181 and passages 165 to the burner tube may be arranged to impart a circumferential (rotational) velocity 184 in the same rotational direction 196 or in an opposite rotational direction 197 as that rotational direction 144 imparted to the gas-fuel mixture by the outer swirler 140. The rotational direction of the compressed air flow through projecting portion 162 relative to the rotational direction of the gas-air mixture from the outer swirler will influence mixing of the gas-fuel and air in the burner tube. The discharging air also tends to cool the tip and will form a thin film of cool air 190 on downstream surface 163. Further, the axial component 183 of velocity of the compressed air entering the burner tube 145 may discourage the rotational flow of hot gases in the burner tube impinging on the nozzle tip. The swirl vanes 181 may further be formed to add a radial velocity component 186 to the gas-air mixture, further influencing mixing within the burner tube space.

Consequently, the volume of compressed air flow, the axial velocity of compressed air flow, the rotational velocity of compressed air flow, and the rotational direction of compressed air flow relative to the rotational flow of the fuel-air mixture from the outer swirler provide adjustable design parameters that improve mixing of fuel and air in the burner tube, thereby promoting reduced emissions and reduced soot formation in startup. Further by creating a cool air film and forcing the rotational flow of hot gases away from the tip of the nozzle, the compressed air flow will cool the tip of the nozzle.

Figure 4:
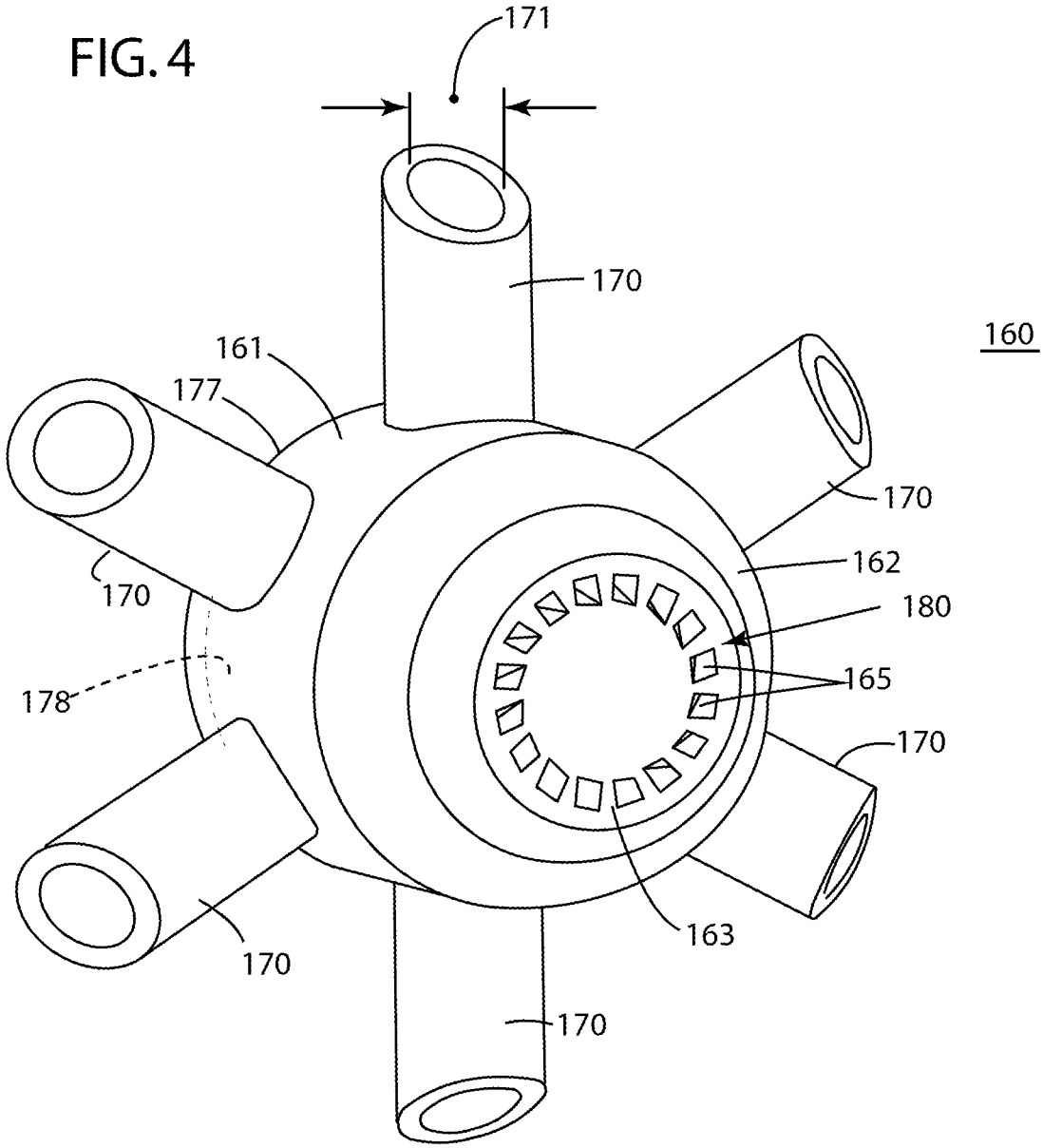
FIG. 4 illustrates an isometric view of an embodiment for the cooling air chamber of the air-staged diffusion nozzle.

FIG. 4 illustrates an isometric view of an embodiment for the cooling air chamber 160 of the air-staged diffusion nozzle. The cooling air chamber 160 includes a peripheral wall 161 forming a generally cylindrical body closed on the upstream end 177 around cooling air cavity within. A projecting portion 162 of frusto-conical shape extends downstream including an inner swirler 180 for the nozzle (not shown) at the downstream end. A plurality of tube members 170 for receiving compressed air into the cooling air cavity 178 extend radially from the peripheral wall 161, preferably in a symmetrical arrangement. The inner diameter 171 of the tubes may be established to provide a sufficient volume of compressed air for the inner swirler 180. The inner swirler 180 may include a plurality of swirl passages 165 that discharge through downstream surface 163 and whose arrangement and flow properties were previously described. The number, shape, size and orientation of the swirl passages 165 may be selected to provide an appropriate volume and flow of compressed air for promoting cooling and mixing in the burner tube space.

Figure 5:
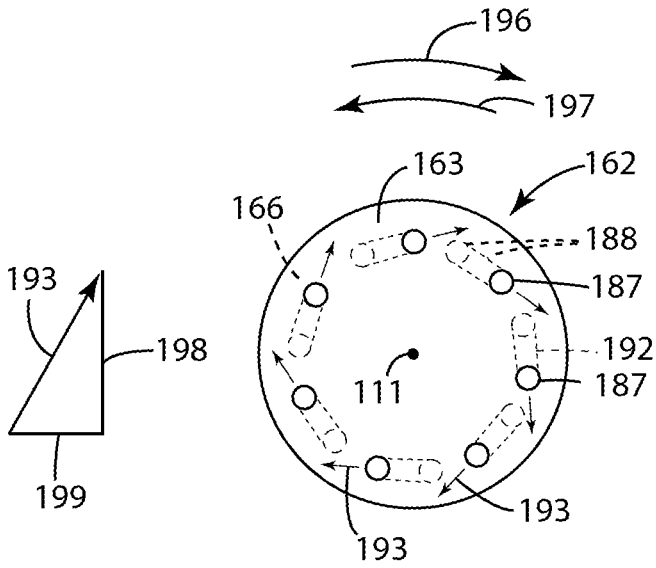
FIG. 5 illustrates an expanded view illustrating cooling air flow through cooling holes in an embodiment of cooling holes at the tip end of the inventive air-staged diffusion nozzle.
Figure 6:
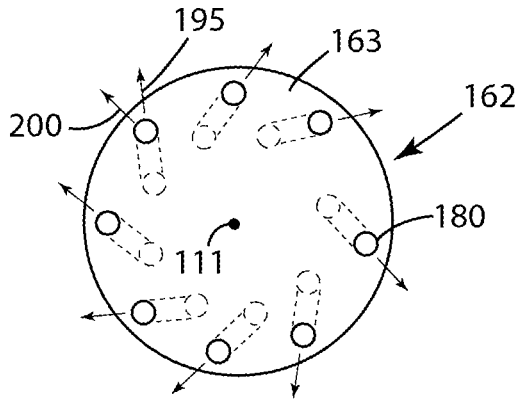
FIG. 6 illustrates an expanded view illustrating an alternative cooling air flow path through cooling holes at the tip end of the inventive air-staged diffusion nozzle providing a radial component to the discharge flow.

FIG. 4 illustrates the downstream face 163 of the projecting portion 162 of an embodiment for the cooling air chamber 160 of the air-staged diffusion nozzle, including tip cooling holes 187. The tip cooling holes 180 may form a circular pattern on the downstream face 163 and on the inner face 166 (FIG. 3) of wall 163 the projecting portion 162 of the cooling air cavity 160. The circular patterns of tip cooling holes on the respective faces 163, 166 may be angularly displaced with respect to the longitudinal axis 111 defining a passage 192 through the projecting portion 152 such that the discharge 193 from the downstream face 163 will include both an axial flow component 198 and a circumferential flow component 199. The angular displacement of the tip cooling holes 180 on respective sides may be alternatively arranged, allowing the circumferential flow component to be reversed, thus allowing the circumferential flow to be in a same rotational direction 196 or an opposed rotational direction 197 to that created by the outer swirler 140 (FIG. 4). Further as shown in FIG. 5, the tip holes 180 may further be arranged to provide a radial displacement between the inner face 166 (FIG. 3) and the downstream face 163 of the downstream wall adding a radial flow component exiting the downstream face 163. While a circular configuration of holes has been illustrated, it should be understood that alternative patterns, shapes, sizes and numbers of holes and discharge direction promoting gas-fuel with air mixing in the burner tube and cooling of the nozzle tip should be considered within the spirit of the present invention.

Figure 7:
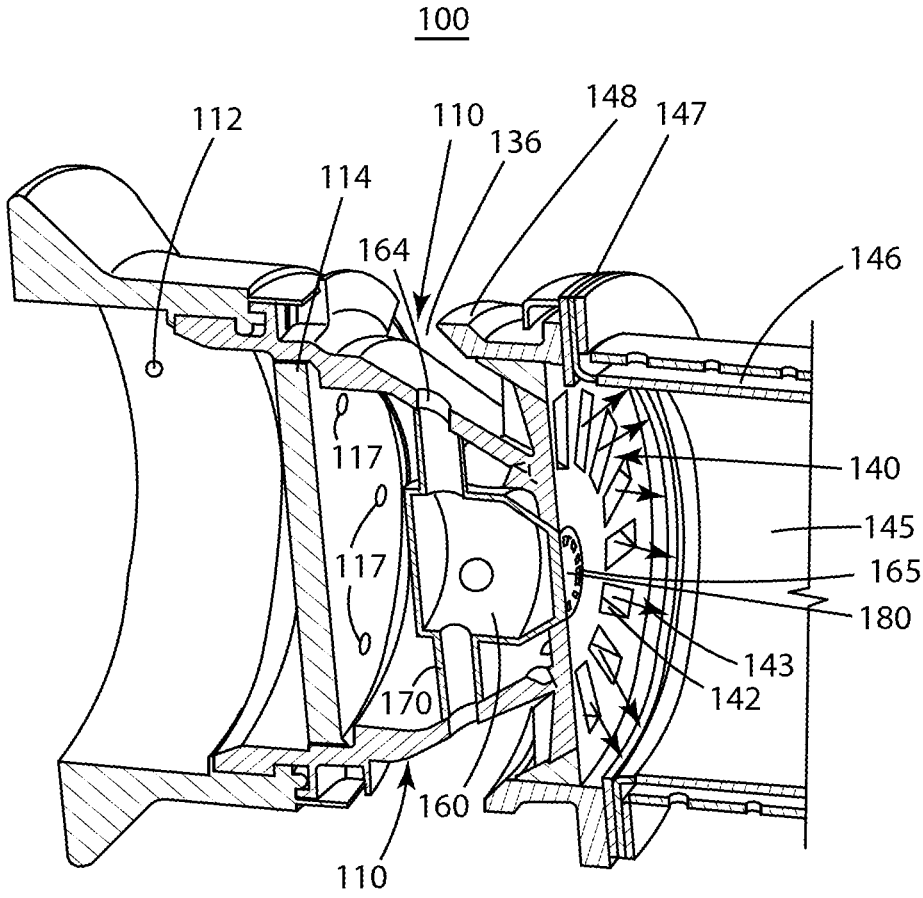
FIG. 7 illustrates an embodiment of the inventive air-staged diffusion nozzle with a burner tube.

FIG. 7 illustrates an expanded view for an embodiment of the inventive air-staged diffusion nozzle with a burner tube. The nozzle 100 receives a gas-fuel from gas-fuel source 112 mounted at upstream end the nozzle body 110 through ports 117 of fuel plate 114. Compressed air is provided at the nozzle body 110 through external space 136. The compressed air passes through the peripheral wall penetrations 164 and then through tube members 170 to the cooling air chamber 160, and past swirler wall extension 148 to outer swirler 140. The burner tube 146 is joined to the nozzle body 110 at nozzle body-burner tube joint 147. Gas-fuel and air mixture 143 from flow passages 142 of outer swirler 140 discharge into burner tube space 145 with rotational swirl and downstream velocity. Compressed air flows through cooling air chamber 160 through swirl passages 165 of inner swirler 180 into burner tube space 145 of burner tube 146 with rotational swirl. The rotational swirl of the flow from the inner swirler passages 180 into the burner tube space 145 may be in the same rotational direction or an opposed rotational direction to the swirl from the outer swirler 140.

FIG. 8 illustrates a cutaway view of an embodiment for a dry-low NOx (DLN) combustor for a gas turbine 300 that includes the inventive air-staged diffusion nozzle 100. The combustor also includes a compressor 312 (partially shown), a plurality of combustors 314 (one shown for convenience and clarity), and a turbine 316 (represented by a single blade). Although not specifically shown, the turbine 316 is drivingly connected to the compressor 312 along a common axis. The compressor 312 pressurizes inlet air, which is then reverse flowed to the combustor 314 where it is used to cool the combustor 314 and to provide air to the combustion process. Although only one combustor 314 is shown, the gas turbine 300 includes a plurality of combustors 314 located about the periphery thereof. A transition duct 318 connects the outlet end of each combustor 314 with the inlet end of the turbine 316 to deliver the hot products of combustion to the turbine 316.

Figure 9:
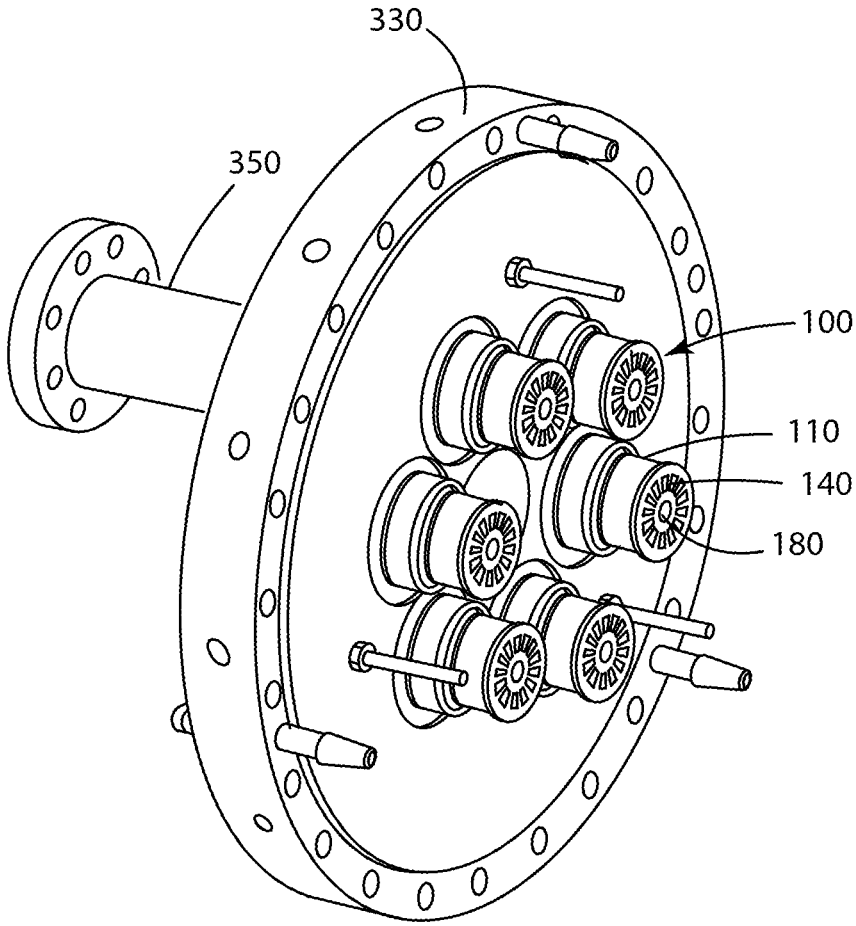
FIG. 9 illustrates the circular arrangement of the air-staged diffusion nozzles with outer swirler and inner swirler on end cover assembly fed from gas-fuel piping.

Each combustor 314 includes a substantially cylindrical combustion casing 324 which is secured at an open forward end to a turbine casing 326 by means of bolts 328. The rearward end of the combustion casing 324 is closed by an end cover assembly 330 which may include conventional supply tubes, manifolds and associated valves, etc. for feeding gas, liquid fuel and air (and water if desired) to the combustor 14. Gas-fuel manifold 350 may supply gas-fuel for the air-staged diffusion nozzle 100. The end cover assembly 330 receives a plurality (for example, six) of the inventive air-staged diffusion nozzle assemblies 100 (only one shown for purposes of convenience and clarity) arranged in a circular array about a longitudinal axis 331 of the combustor 314. FIG. 9 illustrates the circular arrangement of the air-staged diffusion nozzles 100 with outer swirler 140 and inner swirler 180, where the nozzles are mounted on end cover assembly 330 and fed from gas-fuel piping 350.

Again referring to FIG. 8, a secondary fuel nozzle 380 may be mounted at in a centerbody 381. Each air-staged fuel nozzle 100 is supplied gas-fuel 120 from rearward supply section 352 and delivers a swirled gas and air mixture to burner tube space 145.

Within the combustion casing 324, there is mounted, in substantially concentric relation thereto, a substantially cylindrical flow sleeve 334 which connects at its forward end to the outer wall 336 of the transition duct 318. The flow sleeve 334 is connected at its rearward end to the combustion casing 324 where fore and aft sections of the combustor casing 324 are joined.

Within the flow sleeve 334, there is a concentrically arranged combustion liner 338, which is connected at its forward end with the inner wall 340 of the transition duct 318. The rearward end of the combustion liner 38 is supported by a combustion liner cap assembly 342, which is, in turn, supported within the combustion casing 324. It will be appreciated that the outer wall 336 of the transition duct 318, as well as that portion of flow sleeve 334 extending forward of the location where the combustion casing 324 is bolted to the turbine casing 326, may be formed with an array of apertures 344 over their respective peripheral surfaces to permit air to reverse flow from the compressor 312 through the apertures 344 into the annular space between the flow sleeve 334 and the liner 338 toward the upstream or rearward end of the combustor 314 (as indicated by the flow arrows 370).

The arrangement is such that air flowing in the annular space between the liner 338 and the flow sleeve 334 is forced to again reverse direction in the rearward end of the combustor 314 and to flow (See FIG. 1) into space 136 external to the air-staged diffusion nozzle 100, where it is made available for the outer swirler 140 of the nozzle and to the cooling air cavity 160 to flow through the inner swirlers 180, and burner tube space 145, before entering the burning zone or combustion chamber 390.

For prior art diffusion nozzles with only an outer swirler, a recirculation bubble of hot gases may be formed within the burner tube and premixing tubes in response to the swirling fuel-air swirl mixture being discharged from the outer around an outer periphery of the burner tube. This downstream flow of fuel-air mixture encourages a circulation of hot gases from downstream to flow upstream along a center area of the burner tube, thereby bringing the hot gas into proximity of the nozzle tip end. The flow heats the tip end of the nozzle and promotes soot buildup on the tip end of the nozzle during startup and low power operation. With the swirled air from the inner swirler of the inventive air-staged nozzle, the stagnant recirculating hot gas is forced back and away from the tip end. Further, the flow of cool air through the tip end encourages a film of cool air on the tip.

The flow of air from the inner swirler further reduces the fuel mass fraction near the tip end of the nozzle, promoting a uniform unmixed profile with the air-staged nozzle. The low velocity region occurring in the center of the tip end in prior art is altered, as described above, by the swirling discharge of the inner swirler. A high axial velocity at the periphery of the burner tube is also reduced with the air-staged nozzle by due to the inner swirler. Further, the fuel mass fraction becomes more uniform at the burner tube exit relative to prior art and the unmixedness is reduced at the burner tube exit. Here, the improved mixing positively impacts emissions from the gas turbine.

Figure 10:
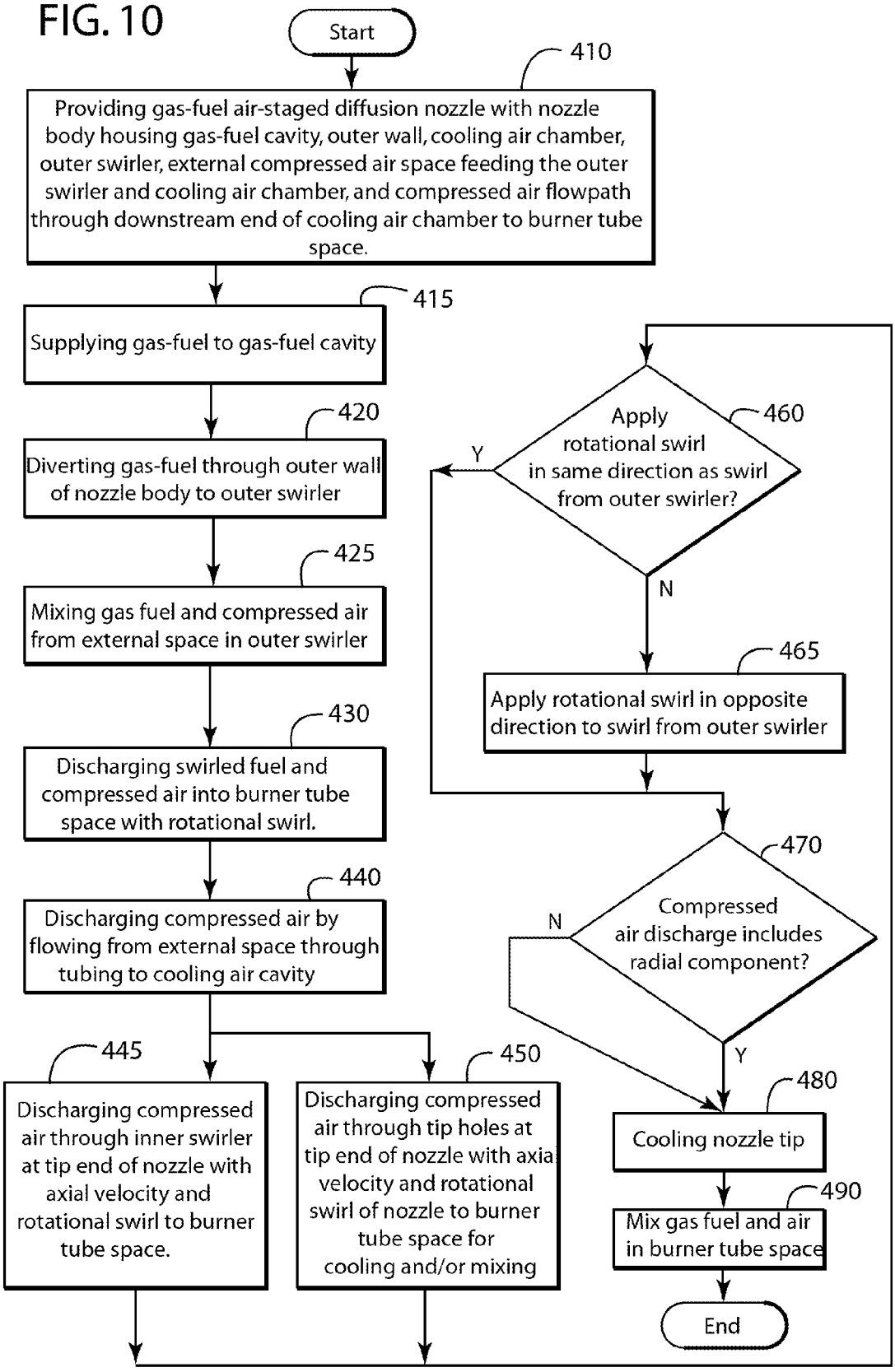
FIG. 10 illustrates a flowchart for a method for cooling a tip of an air-staged diffusion nozzle for a gas turbine combustor.

According to another aspect of the present invention, a method is provided for cooling the tip end of an air-staged diffusion nozzle disposed in a combustor of gas turbine with a compressor and turbine, where the nozzle is disposed upstream from a burner tube of the combustor. FIG. 10 illustrates a flowchart for the method for cooling the nozzle tip of the air-staged diffusion nozzle and mixing gas-fuel and air in burner tube section.

Step 410 provides a gas-fuel air-staged diffusion nozzle where the nozzle includes a nozzle body including a gas-fuel cavity bounded by an outer peripheral wall disposed along a longitudinal axis of the nozzle; an end closure wall, a cooling air chamber disposed within the gas-fuel cavity; an outer swirler supplied by gas-fuel from the gas-fuel cavity and compressed air from an external space surrounding the nozzle body; and a forward projection of the cooling air chamber, extending through the peripheral wall within and projecting through an end closure wall of the central fuel chamber. Step 415 supplies a gas-fuel to the gas-fuel cavity from an upstream gas-fuel source. Step 420 diverts gas-fuel to flow through gas injection holes defined about a periphery of the end closure wall into swirl passages of the outer swirler. Step 425 mixes the gas-fuel with compressed air from the external space within the outer swirler. Step 430 discharges the swirled gas-fuel and compressed air with a rotational direction into a burner tube space downstream from the end closure wall of the nozzle body.

In step 440 the step of diverting the compressed air provides for flowing compressed air from the external space to the cooling air chamber with tubes fluidly connected through the outer peripheral wall of the gas-fuel cavity to the compressed air chamber and fluidly connected through a peripheral wall of the cooling air chamber to a cooling air cavity within. The sizing of the tubes and penetrations through the peripheral walls of the nozzle body and cooling air chamber may be established to provide sufficient compressed air flow for cooling a tip of the nozzle. The sizing of the tubes and penetrations through the peripheral walls of the nozzle body and cooling air chamber may further be established to provide sufficient compressed air flow for promoting mixing of swirled gas-fuel and air within the burner space from the outer swirler. In step 445, diverting the compressed air may further include passing the compressed air through an inner swirler on a forward projection of the peripheral wall of the cooling air chamber on a tip of the nozzle to a space of the burner tube downsteam from the nozzle. Here, sizing of the swirl vane passages and orienting the swirl vane passages are arranged for cooling of the nozzle tip. The sizing of the swirl vane passages and orienting the swirl vane passages may be arranged for mixing of gas-fuel and air within the burner tube space. Step 450 provides alternately for flowing the compressed air through a plurality of tip holes within the forward projection of the peripheral wall of the cooling air chamber. Here, the sizing the of the tip holes and orientation of the tip holes may be arranged for cooling of the nozzle tip or promoting mixing of gas-fuel and air within the burner space or for both functions.

The method may include other arrangements of swirl vanes and tip holes and may further include combinations of swirl vanes and tip holes. A discharge of the compressed air from the nozzle tip may apply a downstream axial velocity and a rotational velocity to the compressed air relative to the longitudinal axis of the nozzle. The rotational velocity applied to the compressed discharged from the nozzle tip air, in step 460, may be in a same direction as a direction of swirl from the outer swirler or for step 465 in an opposite direction to a direction of swirl from the outer swirler. In step 470, the discharge provides cooling for the nozzle tip. In step 480, the discharge provides mixing of the gas-fuel and air from the outer swirler in the burner tube space, where the improved mixing promotes reduced emissions from the gas turbine.

While various embodiments are described herein, it will be appreciated from the specification that various combinations of elements, variations or improvements therein may be made, and are within the scope of the invention.

The invention claimed is:

1. A method of cooling a tip end of an air-staged diffusion nozzle disposed in a combustor of a gas turbine with a compressor and a turbine, wherein the nozzle is upstream from a burner tube of the combustor, the method comprising:

providing an air-staged diffusion nozzle comprising a nozzle body including a gas-fuel cavity bounded by an outer peripheral wall disposed along a longitudinal axis of the nozzle; an end closure wall, a cooling air chamber disposed within the gas-fuel cavity; an outer swirler supplied by gas-fuel from the gas-fuel cavity and compressed air from an external space surrounding the nozzle body; and a forward projection of the cooling air chamber, extending through the peripheral wall of the within and projecting through an end closure wall of the central fuel chamber;

supplying gas-fuel to the gas-fuel cavity from an upstream gas-fuel source;

diverting gas-fuel to flow through gas injection holes defined about a periphery of the end closure wall into swirl passages of the outer swirler;

mixing the gas-fuel with compressed air from the external space within the outer swirler;

discharging the swirled gas-fuel and compressed air with a rotational direction into a burner tube space downstream from the end closure wall of the nozzle body; and diverting compressed air from the external space surrounding the nozzle body through the cooling air chamber to the burner tube space downstream from the end closure wall of the nozzle body, and the step of diverting the compressed air comprising: flowing compressed air from the external space to the cooling air chamber with tubes fluidly connected through the outer peripheral wall of the gas-fuel cavity to the cooling air chamber and fluidly connected through a peripheral wall of the cooling air chamber to a cooling air cavity within, and the step of diverting comprising: sizing the tubes and penetrations through the peripheral walls of the nozzle body and cooling air chamber to provide sufficient compressed air flow for promoting mixing of gas-fuel and air within the burner space.

2. The method of claim 1, the step of diverting comprising: sizing the tubes and penetrations through the peripheral walls of the nozzle body and cooling air chamber to provide sufficient compressed air flow for cooling a tip of the nozzle.

3. The method of claim 1, the step of diverting the compressed air comprising: sizing the tubes and penetrations through the peripheral walls of the nozzle body and cooling air chamber to provide sufficient compressed air flow for promoting mixing of gas-fuel and air within the burner space.

4. The method of claim 1, the step of passing compressed air comprising: swirling the compressed air through a swirler including swirl vanes within the forward projection of the peripheral wall of the cooling air chamber.

5. The method of claim 4, the step of passing compressed air comprising:

sizing the swirl vane passages and orienting the swirl vane passages for cooling of the nozzle tip.

6. The method of claim 1, the step of passing the compressed air comprising:

sizing the swirl vane passages and orienting the swirl vane passages for promoting mixing of gas-fuel and air within the burner space.

7. The method of claim 1, the step of diverting the compressed air comprising:

flowing the compressed air through a plurality of tip holes within the forward projection of the peripheral wall of the cooling air chamber.

8. The method of claim 7, the step of flowing the compressed air comprising:

applying a downstream axial velocity and a rotational velocity to the compressed air relative to the longitudinal axis of the nozzle.

9. The method of claim 7, the step of flowing compressed air comprising:

sizing the tip holes and orienting the tip holes for cooling of the nozzle tip.

10. The method of claim 7, the step of flowing compressed air comprising:

sizing the tip holes and orienting the tip holes for promoting mixing of gas-fuel and air within the burner space.

11. The method of claim 1, the step of passing the compressed air comprising: applying a downstream axial velocity to the compressed air relative to the longitudinal axis of the nozzle; and applying a rotational velocity to the compressed air relative to the longitudinal axis of the nozzle.

12. The method of claim 11, the step of passing the compressed air comprising:

applying a rotational velocity to the compressed air in a same direction as a direction of swirl from the outer swirler.

13. The method of claim 11, the step of passing the compressed air comprising:

applying a rotational velocity to the compressed air in an opposite direction to a direction of swirl from the outer swirler.

14. The method of claim 1, wherein the compressed air is provided from the discharge of the compressor for the gas turbine.

15. A method of operating a gas-fuel air-staged diffusion nozzle disposed in a combustor of a gas turbine with a compressor and a turbine, wherein the nozzle is upstream from a burner tube of the combustor, the method comprising:

providing a gas-fuel air-staged diffusion nozzle comprising a nozzle body including a gas-fuel cavity bounded by an outer peripheral wall disposed along a longitudinal axis of the nozzle; an end closure wall, a cooling air chamber disposed within the gas-fuel cavity; an outer swirler supplied by gas-fuel from the gas-fuel cavity and compressed air from an external space surrounding the nozzle body; and an inner swirler at a downstream end of the nozzle;

supplying gas-fuel to the gas-fuel cavity from an upstream gas-fuel source;

diverting gas-fuel to flow through gas injection holes defined about a periphery of the end closure wall into swirl passages of the outer swirler;

mixing the gas-fuel with compressed air from the external space within the outer swirler;

discharging the swirled gas-fuel and compressed air from the outer swirler with a rotational direction into a burner tube space downstream from the nozzle body; and diverting compressed air from the external space surrounding the nozzle body into the cooling air chamber; and swirling the compressed air in the cooling air chamber through an inner swirler at a center of the tip end of the nozzle into the burner tube space downstream from nozzle, and the step of swirling further comprising swirling the compressed air with an axial velocity component and a rotational velocity component with respect to the longitudinal axis of the nozzle into the burner tube.

16. The method of claim 15, the step of swirling further comprising: reducing the unmixedness of the swirling gas-fuel and air mixture from the outer swirler in the burner tube space with swirling compressed air from the inner swirler, wherein the swirling air from the inner swirler flows in one of a same direction and an opposite direction from the swirling mixture from the outer swirler.

17. The method of claim 15, the step of swirling further comprising:

cooling the tip end of the nozzle by pushing away hot gases within the burner tube space with the swirling compressed air from the inner swirler.

* * * * *

UNITED STATES PATENT AND TRADEMARK OFFICE

CERTIFICATE OF CORRECTION

PATENT NO. : 8,528,338 B2
APPLICATION NO. : 12/960782
DATED : September 10, 2013
INVENTOR(S) : Desai et al.

It is certified that error appears in the above-identified patent and that said Letters Patent is hereby corrected as shown below:

On the Title Page, in Item (73), under "Assignee", in Column 1, Lines 1-2, delete "St. Paul, MN (US)" and insert -- Schenectady, NY (US) --, therefor.

On the Title Page, in the Figure, for Tag "450", in Line 3, delete "axia" and insert -- axial --, therefor.

In the Drawings:

In Fig. 10, Sheet 9 of 9, for Tag "450", in Line 3, delete "axia" and insert -- axial --, therefor.

In the Specification:

In Column 3, Line 38, delete "tube; and" and insert -- tube; --, therefor.

In Column 6, Line 57, delete "combustor 14." and insert -- combustor 314. --, therefor.

In Column 8, Line 42, delete "downsteam" and insert -- downstream --, therefor.

In the Claims:

In Column 9, Lines 18-19, in Claim 1, delete "wall of the within" and insert -- wall within --, therefor.

Signed and Sealed this
Twelfth Day of November, 2013

Teresa Stanek Rea

Teresa Stanek Rea
*Deputy Director of the United States Patent and Trademark Office*